US005616237A

United States Patent [19]

Krishna et al.

[11] Patent Number: 5,616,237

[45] Date of Patent: Apr. 1, 1997

[54] SPLIT FEED INJECTION FLUID CATALYTIC CRACKING PROCESS

[75] Inventors: Ashok S. Krishna, Redondo Beach, Calif.; Robert C. Skocpol, Amersfoort, Netherlands; Lewis A. Frederickson, Oakland, Calif.

[73] Assignee: Chevron Research and Technology Company, A Division of Chevron U.S.A. Inc., San Francisco, Calif.

[21] Appl. No.: 626,618

[22] Filed: Apr. 1, 1996

Related U.S. Application Data

[63] Continuation of Ser. No. 259,313, Jun. 13, 1994, abandoned.

[51] Int. Cl.[6] ..... C10G 11/05

[52] U.S. Cl. ..... 208/120; 208/49; 208/78; 208/80; 208/113

[58] Field of Search ..... 208/120, 80, 113, 208/49, 78

[56] References Cited

U.S. PATENT DOCUMENTS 4,584,090 4/1986 Farnsworth ..... 208/80

4,869,807 9/1989 Krishna et al. ..... 208/80

*Primary Examiner*—Helane E. Myers

*Attorney, Agent, or Firm*—Timothy J. Hadlock

[57] ABSTRACT

A fluid catalytic cracking unit equipped with multiple feed injection points along the length of the riser is operated such that portions of the same fresh feed are charged to different feed injection points. Preferably, the hydrocarbon fresh feed can be split into two or more non-distinct fractions, with one fraction charged to the bottom injection point along the length of the riser reactor, and the remaining fractions charged to injection points progressively higher up along the length of the riser reactor with the temperature of the upper injection feed fractions being different from that of the lowest injection point fraction prior to entry into the FCC riser reactor. Hydrocarbon products from the cracking process can be recycled to one or more of the various injection points along the length of the riser.

14 Claims, 1 Drawing Sheet

SPLIT FEED INJECTION FLUID CATALYTIC CRACKING PROCESS

This is a continuation of application Ser. No. 08/259,313, filed Jun. 13, 1994 now abandoned.

FIELD OF INVENTION

The invention relates generally to catalytic cracking of hydrocarbons. In one aspect the invention relates to an improvement in the method of splitting the hydrocarbon feed and charging a portion of the total feed near the bottom of an elongated riser reactor, and the remaining portions progressively further up the riser. The improvement comprises a change in the temperature of the upper injection feeds relative to the lowest injection feed, so as to minimize undesirable $C_2$- gas or coke make while optimizing gasoline octanes.

BACKGROUND OF THE INVENTION

Feedstocks containing higher molecular weight hydrocarbons are cracked by contacting the feedstocks under elevated temperatures with a cracking catalyst whereby light and middle distillates are produced. Typically, the octane number of the light distillate (gasoline) is dependent upon the riser temperature, conversion level of operation or the catalyst type. Therefore, to increase the octane number of the gasoline, conversion of the hydrocarbon feed to lighter products must be increased by preferably raising the temperature of operation, or by increasing other operating variables such as catalyst to oil ratio. Unfortunately, a limit on the maximum operating temperature is set by reactor metallurgy, gas compressor constraint or other operating constraints. Increasing conversion by other means may also result in poor selectivity to desired products. The octane number of the gasoline may be increased by switching from a catalyst containing rare earth-exchanged Y zeolite to one containing ultrastable Y zeolite or ZSM-5, as is well known in prior art; however, such a switch will generally involve substantially higher costs, be time consuming, and above all, lead to significant reductions in the yield of gasoline.

U.S. Pat. No. 4,869,807 teaches that a desirable way to advantageously increase the octane number of the gasoline produced in the process is to charge some of the fresh hydrocarbon feed to upper injection points along the length of the riser while charging a majority of the fresh feed to the bottom of the riser.

One problem with the process as taught in U.S. Pat. No. 4,869,807 is that an undesirable increase in $C_2$- gas make accompanies the desirable increase in gasoline octanes (see Examples I, II and III, Tables II, III and IV in U.S. Pat. No. 4,869,807).

Therefore, it is desirable to have a modified cracking process available for increasing the octane number of the gasoline while minimizing the disadvantages associated with practices described in the prior art.

It is thus one object of this invention to provide a regenerable fluid catalytic cracking process, and a further object of this invention to provide a process for increasing the octane number of the gasoline from the process. Another object of this invention is to achieve the increase in octane number of the gasoline while minimizing undesirable gas make, or coke make, by modifying the method of introduction of feed to the riser reactor in a fluid catalytic cracking process.

SUMMARY OF THE INVENTION

The prevent invention is directed to a process for the conversion of an unsegregated hydrocarbon feed of a full boiling range in an FCC riser reactor employing zeolitic catalyst there throughout which comprises:

(a) splitting the hydrocarbon feed and continuously injecting said hydrocarbon feed at a plurality of positions along the length of said FCC riser reactor, wherein about 25 to 75 volume percent of said feed is injected to the lowest injection position;

(b) apportioning throughput through said positions along said length of said FCC riser reactor;

(c) adjusting the temperatures of the feed streams so as to make the temperatures of the upper injection feed streams distinct and different from the temperature of the lowest injection feed, to optimize octane numbers of the gasoline and/or minimize coke or gas make;

(d) recycling regenerated catalyst to the bottom of said FCC riser reactor; and (e) lifting said regenerated catalyst up said FCC riser reactor to said lowest injection position of said hydrocarbon oil feed with a flow of gas.

In accordance with the process of the present invention, a typical, full boiling range hydrocarbon feed to a fluid catalytic cracking process can be split into two or more non-distinct fractions, with one fraction charged to the bottom of the riser reactor, and the other remaining fractions charged to upper injection points along the riser, with the temperatures of the upper injection feeds changed so that they are different from the temperature of the lowest injection feed.

The temperatures of the upper injection feeds can be lower or higher than that of the lowest injection feed, depending on whether minimization of coke or $C_2$- gas make (lower temperature for upper injection feed), or maximization of gasoline octanes (higher temperature for upper injection feed), is the objective. The temperatures of the upper injection feeds can be 50° F. to 500° F. different from the lowest injection feed, and preferably 100° F. to 300° F. different from the lowest injection feed.

The distribution of feed between lower and upper injection points can cover a wide range, with between 10 and 90 volume percent of the total feed charged to bottom injector, and between 90 and 10 volume percent of total feed charged to upper injection points. In a preferred embodiment, between about 25 to 75 volume percent is injected to the lowest injection point. Typical yield shifts associated with the process of the present invention, as compared to prior art practices described in U.S. Pat. No. 4,869,807, include: substantially equivalent or higher octane number of the gasoline produced, substantially equivalent or higher yield of gasoline, and substantially equivalent or lower yields of coke and $C_2$- gas make. Although gasoline octane benefits accrue even when a majority of the feed is charged to upper injection points, and a minority to the bottom injector in accordance with the present invention, maximum improvements in gasoline octane and yields of desirable liquid products are achieved when a majority of the feed is charged to the bottom injector. Thus a preferred embodiment of the present invention is a modified fluid catalytic cracking process wherein the hydrocarbon feed is split into several non-distinct or unsegregated fractions (e.g., unsegregated by boiling point, aromatics content, etc.), and a major portion of the feed is charged to the lowest injection point in a riser reactor, and the remaining fractions, at different temperatures relative to the lowest injection feed, progressively higher up along the length of the riser reactor.

A further preferred embodiment of the present invention is characterized by all or substantially all of the hydrocarbon feed being apportioned between the lowest injection point and one additional injection point higher up along the length of the riser, with the temperature of the lowest and upper injection points being different.

Preferably, the distance between the lowest injection point and the next highest injection comprises at least about 20% of the total length of the riser reactor.

The advantages associated with practicing the teachings of the present invention will become clearer upon reading the examples which are to follow.

DETAILED DESCRIPTION OF THE INVENTION

Figure 1:
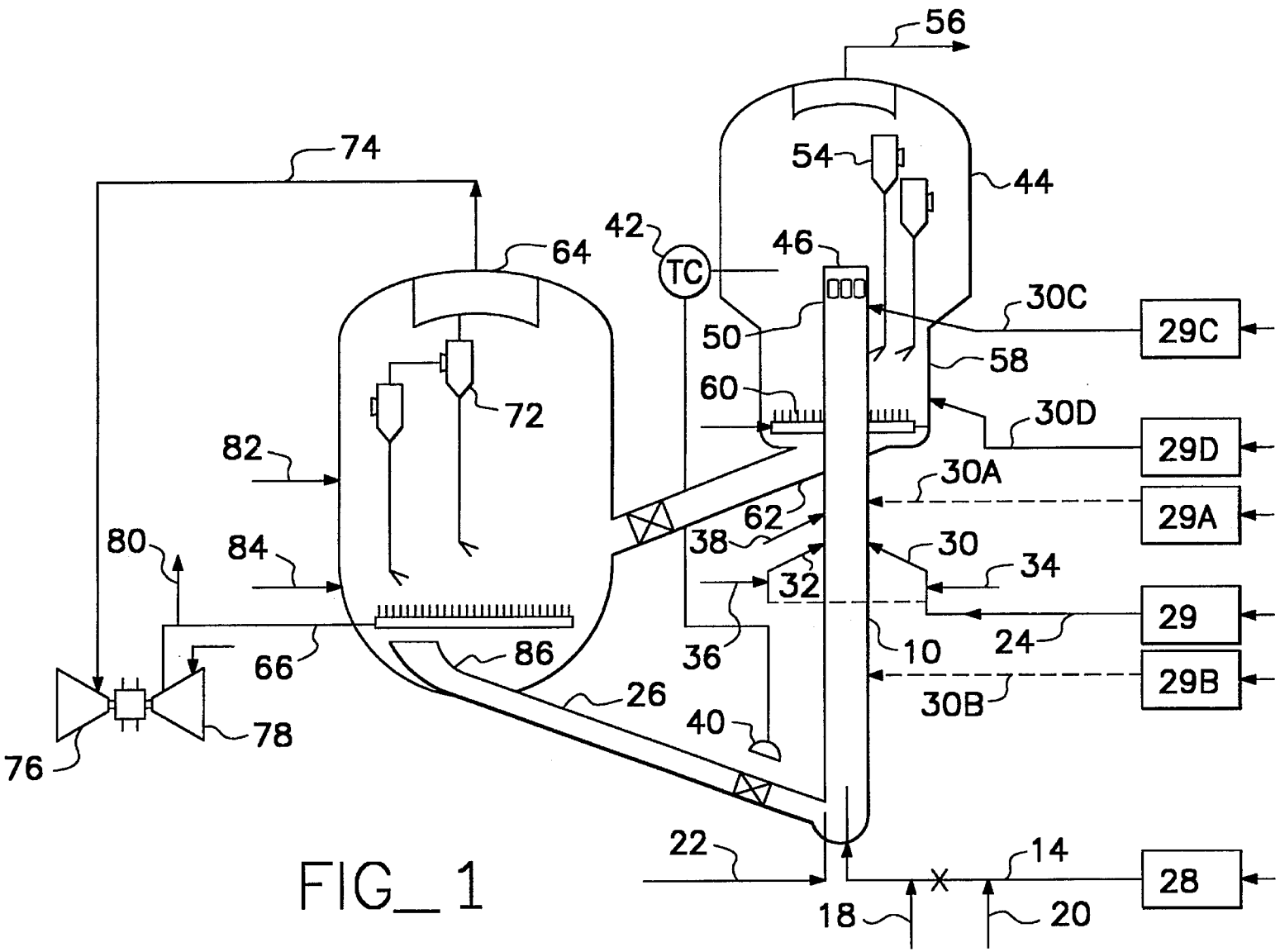
FIG. 1 shows a schematic rendition of an apparatus used to practice the process of the present invention.

A suitable reactor-regenerator system for performing this invention is described in reference to FIG. 1. The cracking occurs with a fluidized zeolitic catalyst in an elongated reactor tube 10, which is referred to as a riser. The riser has a length to diameter ratio of above 20, or preferably above 25. Hydrocarbon oil feed to be cracked can be charged directly into the bottom of the riser through inlet line 14 or it can be charged to upper injection points in the riser through lines 30A, 30B, or 30C or directly into the reactor vessel through line 30D. Prior to charging to the riser, the hydrocarbon feed streams can be routed through heat exchangers or fired preheater furnaces designated as 28, 29, 29A, 29B, 29C, and 29D. A gas, preferably steam, is introduced into the lower feed injection point through line 18. A gas, preferably steam, is also introduced independently to the bottom of the riser through line 22 to help carry upwardly into the riser regenerated catalyst which flows to the bottom of the riser through transfer line 26. Other examples of such a gas include recycle absorber gas, nitrogen, methane, ethane, ethylene, propane, propylene, butane, butylene, hydrogen, hydrogen sulfide, ammonia and the like and combinations thereof.

Feed to the upper injection points is introduced at about a 45 degree upward angle into the riser through lines 30 and 32. Prior to introduction into the riser, the hydrocarbon feed streams are passed through heat exchangers and/or fired heaters, 28 and 29, such that the temperature of the upper injection feeds are different from those of the lowest injection feed stream, 14. A gas, as described above and preferably steam, can be introduced into the upper feed injection inlet lines through lines 34 and 36. Upper hydrocarbon feed injection lines 30 and 32 each represent a plurality of similar lines spaced circumferentially at the same height of the riser. Any recycle hydrocarbon can be admitted to the lower section of the riser through one of the inlet lines designated as 20, or to the upper section of the riser through one of the lines designated as 38. The recycle hydrocarbon can also be passed through heat exchangers and other processing steps, such as hydrotreatment, prior to introduction into the riser. The recycled hydrocarbon oil has boiling point greater than 90° F. and preferably greater than 650° F. For example, the recycle may be gasoline produced in the process boiling between 90° F. and 430° F. or a light cycle oil boiling between 430° F. and 650° F. The residence time of hydrocarbon feed in the riser can be varied by varying the amounts or positions of introduction of the feed.

The full range oil charge to be cracked in the riser is a gas oil having a boiling range of about 430° F. to 1100° F. The feedstock to be cracked can also include appreciable amounts of virgin or hydrotreated residua having a boiling range of 900° F. to 1500° F. The gas added to the riser amounts to about 2 wt. % based on the oil charge, but the amount of gas can vary widely. The catalyst employed may be fluidized zeolitic aluminosilicate and is preferably added to the bottom only of the riser. The type of zeolite in the catalyst can be a rare earth-exchanged X or Y, hydrogen Y, ultrastable Y, superstable Y or ZSM-5 or any other zeolite typically employed in the cracking of hydrocarbons. The riser outlet temperature range is preferably about 900° F. to 1100° F. and is controlled by measuring the temperature of the product from the risers and then adjusting the opening of valve 40 by means of temperature controller 42 which regulates the inflow of hot regenerated catalyst to the bottom of the riser. The temperature of the regenerated catalyst should be above the control temperature in the riser so that the incoming catalyst contributes heat to the cracking reaction. The riser pressure should be between about 10 and 35 psig. Between about 0 and 10% of the oil charge to the riser is recycled with the fresh oil feed to the bottom of the riser.

The residence time of both hydrocarbon and catalyst in the riser is very small and preferably ranges from 0.5 to 5 seconds. The velocity throughout the riser is about 35 to 65 feet per second and is sufficiently high so that there is little or no slippage between the hydrocarbon and catalyst flowing through the riser. Therefore, no bed of catalyst is permitted to build up within the riser, whereby the density within the riser is very low. The density within the riser ranges from a maximum of about 4 pounds per cubic foot at the feed injection point at the bottom of the riser and decreases to about 2 pounds per cubic foot at the top of the riser. Since no dense bed of catalyst is ordinarily permitted to build up within the riser, the space velocity through the riser is usually high and ranges between 100 or 120 and 600 weight of hydrocarbon per hour per instantaneous weight of catalyst in the reactor. No significant catalyst buildup within the reactor should be permitted to occur and the instantaneous catalyst inventory within the riser is due to a flowing catalyst to oil weight ratio between about 4:1 and 15:1, the weight ratio corresponding to the feed ratio. The hydrocarbon and catalyst exiting from the top of each riser is passed into a disengaging vessel 44. The top of the riser is capped at 46 so that discharge occurs through lateral slots 50 for proper dispersion. An instantaneous separation between hydrocarbon and catalyst occurs in the disengaging vessel. The hydrocarbon which separates from the catalyst is primarily gasoline together with middle distillate and heavier components and some lighter gaseous components. The hydrocarbon effluent passes through cyclone system 54 to separate catalyst fines contained therein and is discharged to a fractionator through line 56. The catalyst separated from hydrocarbon in disengager 44 immediately drops below the outlets of the riser so that there is no catalyst level in the disengager but only in a lower stripper section 58. A gas, as described above and preferably steam, is introduced into catalyst stripper section 58 through sparger 60 to remove any entrained hydrocarbon in the catalyst.

Catalyst leaving stripper 58 passes through transfer line 62 to a regenerator 64. This catalyst contains carbon deposits which tend to lower its cracking activity and as much carbon as possible must be burned from the surface of the catalyst. The burning is accomplished by introduction to the regenerator through line 66 of approximately the stoichiometrically required amount of air for combustion of the carbon deposits. The catalyst from the stripper enters the bottom section of the regenerator in a radial and downward direction through transfer line 62. Flue gas leaving the dense catalyst bed in regenerator 64 flows through cyclones 72 wherein catalyst fines are separated from flue gas permitting the flue gas to leave the regenerator through line 74 and pass through a turbine 76 before leaving for a waste heat boiler, wherein any carbon monoxide contained in the flue gas is burned to carbon dioxide to accomplish heat recovery. Turbine 76 compresses atmospheric air in air compressor 78 and this air is charged to the bottom of the regenerator through line 66.

The temperature throughout the dense catalyst bed in the regenerator is about 1200° F. to 1400° F. The temperature of the flue gas leaving the top of the catalyst bed in the regenerator can rise due to afterburning of carbon monoxide to carbon dioxide. Approximately a stoichiometric amount of oxygen is charged to the regenerator in order to minimize afterburning of carbon monoxide to carbon dioxide above the catalyst bed, thereby avoiding injury to the equipment, since at the temperature of the regenerator flue gas some afterburning does occur. In order to prevent excessively high temperatures in the regenerator flue gas due to afterburning, the temperature of the regenerator flue gas is controlled by measuring the temperature of the flue gas entering the cyclones and then venting some of the pressurized air otherwise destined to be charged to the bottom of the regenerator through vent line 80 in response to this measurement. Alternatively, CO oxidation promoters can be employed, as is now well known in the art, to oxidize the CO completely to $CO_2$ in the regenerator dense bed thereby eliminating any problems due to afterburning in the dilute phase. With complete CO combustion, regenerator temperatures can be in excess of 1250° F. up to 1500° F. The regenerator reduces the carbon content of the catalyst from about 1.0 wt. % to 0.2 wt. %, or less for the maximum gasoline mode of operation. If required, steam is available through line 82 for cooling the regenerator. Makeup catalyst may be added to the bottom of the regenerator through line 84. Hopper 86 is disposed at the bottom of the regenerator for receiving regenerated catalyst to be passed to the bottom of the reactor riser through transfer line 26.

TABLE I

FEEDSTOCK INSPECTIONS

| Description | Feed 1 |
|---|---|
| API Gravity | 25.07 |
| Sulfur: wt. % | 0.11 |
| Nitrogen: wt. % | 0.201 |
| Carbon Residue: wt. % | 0.08 |
| Aniline Point: °F. | 180.4 |
| Viscosity @ 212° F., cSt | 4.712 |
| Pour Point: °F. | 102 |
| Distillation: D1160 | |
| 10% | 621 |
| 30% | 726 |
| 50% | 791 |
| 70% | 846 |
| 90% | 936 |

EXAMPLES

To demonstrate the efficacy of our invention, a number of tests were conducted on a circulating pilot plant of the fluid catalytic cracking process using the feedstock described in Table I.

Example I

In this example, the feedstock described in Table I was cracked over conventional rare earth-exchanged Y zeolite containing catalyst in the fluid catalytic cracking pilot plant. Run No. 1 corresponds to a conventional fluid catalytic cracking process wherein all the fresh feed is charged to the bottom of the riser reactor ("base case"). In Run No. 2, 60 volume percent of the fresh feed was charged to the bottom of the riser, and the remaining 40 volume percent to an upper injection point in the riser; the temperature of the bottom and upper injector feeds was the essentially same, and equal to the temperature of the feed in the base case. Run No. 2 conditions were in accordance with the teachings of U.S. Pat. No. 4,869,807, and the run is, henceforth, referred to as "split feed injection".

In Run No. 3, the feed was split between the bottom and upper injectors in the riser reactor exactly as in Run No. 2; in addition, and in accordance with the teachings of the present invention, the temperature of the upper injector feed was substantially (lower by around 200° F.) different from that of the bottom injector feed. Reaction conditions and results for Runs 1, 2 and 3 are shown in Table II.

Comparing the results from Run Nos. 1 and 2, it is apparent that the teachings of U.S. Pat. No. 4,869,807 associated with split feed injection to the riser reactor, namely, higher gasoline octanes, are borne out. However, an increase in $C_2$ and lighter gases is also observed for Run No. 2 relative to Run No. 1, similar to the results shown in the examples of U.S. Pat. No. 4,869,807. For units that are constrained by fuel gas handling capacity, this gas increase is a debit and indeed, in certain instances, can prevent the application of split feed injection technology as taught in the prior art. In Run No. 3, the temperature of the upper injector feed was lowered by 200° F. relative to the bottom injector feed (from 649° F. to 449° F.). Since no other adjustments were made, and all other conditions were the same as those in Run No. 2, the riser outlet temperature dropped by 19° F. in this case, from 964° F. for Run Nos. 1 and 2, to 945° F. for Run No. 3. Comparing the results of the three runs, it is apparent that the "improved split feed injection" case (Run No. 1) results in lower $C_2$ and lighter gas than the "split feed injection" case (Run No. 2), and indeed, lower than the "base case" (Run No. 3). The yield of gasoline is maintained in Run No. 3 relative to Run No. 2, and the octane numbers of the gasoline are higher than the "base case" (Run No. 1) and only slightly lower than the prior art "split feed injection case" (Run No. 2).

Thus, the improvements that result from the present invention permit application of split feed injection technology even when the FCC unit is constrained by $C_2$ and lighter gas make, allowing significant octane gains to be achieved without attendant $C_2$- gas increases associated with prior art.

TABLE II

| Run Number | 1 | 2 | 3 |
|---|---|---|---|
| Operating Conditions | | | |
| Riser Outlet Temp., °F. | 964 | 964 | 945 |
| Riser Inlet Temp., °F. | 1212 | 1204 | 1205 |
| Catalyst/Oil Ratio | 7.9 | 7.7 | 7.8 |
| Volume % Feed to Bottom Injector | 100 | 60 | 60 |
| Volume % Feed to Upper Injector | 0 | 40 | 40 |
| Temperature of Feed to Bottom Injector | 647 | 649 | 650 |

TABLE II-continued

| Run Number | 1 | 2 | 3 |
|---|---|---|---|
| Temperature of Feed to Top Injector | — | 649 | 449 |
| Conversion: wt. % FF | 70.7 | 69.6 | 68.1 |
| Product Yields: wt. % FF | | | |
| $C_2$ and Lighter | 1.41 | 1.57 | 1.36 |
| Total | | | |
| $C_3$ | 4.43 | 4.98 | 4.50 |
| $C_3$ = | 3.89 | 4.38 | 3.93 |
| Total | | | |
| $C_4$ | 8.89 | 9.79 | 8.71 |
| $iC_4$ | 2.36 | 2.48 | 2.33 |
| $C_4$ = | 6.10 | 6.83 | 5.94 |
| Gasoline | 52.60 | 50.0 | 50.2 |
| Light Cycle Oil | 18.95 | 19.2 | 19.9 |
| Decanted Oil | 10.35 | 11.2 | 12.0 |
| Coke | 3.34 | 3.25 | 3.29 |
| Gasoline | | | |
| Motor Octane Clear | 78.8 | 79.7 | 79.1 |
| Research Octane Clear | 91.6 | 92.2 | 92.3 |
| Overall Octane (R + M/2) | 85.2 | 86.0 | 85.7 |

Example II

In this example, the same feed and catalyst were employed as in Example I. Again, a run that was conducted in accordance with the present invention (Run No. 4) is compared against the "base case" (Run No. 1) and the prior art "split feed injection" case (Run No. 2) in Table III. Run No. 4 is similar to Run No. 3 of Example I and Table II in that the upper injection feed temperature is 200° F. lower than the bottom injector feed temperature; however, instead of allowing the riser outlet temperature to fall, the catalyst/oil ratio was raised to maintain riser outlet temperature at 965° F.

Comparing the results in Table III of Run No. 4 with those of Run Nos. 1 and 2, another embodiment of the present invention is demonstrated: if slightly higher coke and gas ($C_2$ and lighter) make can be accommodated on the unit, octane gains from split feed injection substantially greater than those achieved by the process of U.S. Pat. No. 4,869,807 are obtained.

TABLE III

| Run Number | 1 | 2 | 4 |
|---|---|---|---|
| Operating Conditions | | | |
| Riser Outlet Temp., °F. | 964 | 964 | 965 |
| Riser Inlet Temp., °F. | 1212 | 1204 | 1205 |
| Catalyst/Oil Ratio | 7.9 | 7.7 | 8.7 |
| Volume % Feed to Bottom Injector | 100 | 60 | 60 |
| Volume % Feed to Upper Injector | 0 | 40 | 40 |
| Temperature of Feed to Bottom Injector | 647 | 649 | 648 |
| Temperature of Feed to Top Injector | — | 649 | 449 |
| Conversion: wt. % FF | 70.7 | 69.6 | 71.1 |
| Product Yields: wt. % FF | | | |
| $C_2$ and Lighter | 1.41 | 1.57 | 1.70 |
| Total | | | |
| $C_3$ | 4.43 | 4.98 | 5.47 |

TABLE III-continued

| Run Number | 1 | 2 | 4 |
|---|---|---|---|
| $C_3$ = | 3.89 | 4.38 | 4.78 |
| Total | | | |
| $C_4$ | 8.89 | 9.79 | 10.45 |
| $iC_4$ | 2.36 | 2.48 | 2.74 |
| $C_4$ | 6.10 | 6.83 | 7.16 |
| Gasoline | 52.60 | 50.0 | 49.9 |
| Light Cycle Oil | 18.95 | 19.2 | 18.5 |
| Decanted Oil | 10.35 | 11.2 | 10.3 |
| Coke | 3.34 | 3.25 | 3.58 |
| Gasoline | | | |
| Motor Octane Clear | 78.8 | 79.7 | 80.3 |
| Research Octane Clear | 91.6 | 92.2 | 93.0 |
| Overall Octane (R + M/2) | 85.2 | 86.0 | 86.65 |

Example III

In Examples I and II, the temperature of the upper injector feed was lower than that of the bottom injector feed for the runs that helped demonstrate the efficacy of the present invention.

In this example, we wish to discuss a situation wherein the temperature of the upper injector feed is raised relative to the bottom injector feed. This improvement would be useful in FCC units which are not limited by $C_2$- gas handling capacity but are limited by coking burning capacity. In this instance, raising the temperature of the upper injector feed relative to the bottom injector feed will lower catalyst/oil ratio relative to Run Nos. 1 and 2, and result in lower coke make; however, the octane number of the gasoline should still be greater than that for the "base case" (Run No. 1) and almost equal to that for Run No. 2.

What is claimed is:

1. A process for the conversion of an unsegregated hydrocarbon feed of a full boiling range in an FCC riser reactor employing zeolitic catalyst there throughout which comprises:

(a) splitting the hydrocarbon feed and continuously injecting said hydrocarbon feed at a plurality of positions along the length of said FCC riser reactor, wherein about 25 to 75 volume percent of said feed is injected to the lowest injection position;

(b) apportioning throughput through said positions along said length of said FCC riser reactor;

(c) adjusting the temperatures of the feed streams so as to make the temperatures of the upper injection feed streams at least about 200° F. less than the temperature of the lowest injection feed, to optimize octane numbers of the gasoline and/or minimize coke or gas make;

(d) recycling regenerated catalyst to the bottom of said FCC riser reactor; and (e) lifting said regenerated catalyst up said FCC riser reactor to said lowest injection position of said hydrocarbon oil feed with a flow of gas.

2. The process of claim 1 wherein the distance between said lowest injection position and the next highest injection position comprises at least about 20% of the total length of said riser reactor.

3. The process of claim 1 wherein the temperatures of said hydrocarbon feed streams is in the range of 200° F. to 800° F. prior to entering the FCC riser reactor.

4. The process of claim 1 which further comprises recycling hydrocarbon oil to one or more injection positions along the length of the riser.

5. The process of claim 4 wherein said recycle hydrocarbon oil is gasoline produced in the process, boiling between 90° F. and 430° F.

6. The process of claim 4 wherein said recycle hydrocarbon oil comprises light cycle oil boiling between 430° F. and 650° F.

7. The process of claim 4 wherein said recycle hydrocarbon oil comprises heavy cycle oil boiling above 650° F.

8. The process of claim 1 wherein said gas is catalytically inert.

9. The process of claim 1 wherein said gas is steam.

10. The process of claim 1 wherein said gas is recycled absorber gas.

11. The process of claim 1 wherein said catalytically inert gas is selected from the group consisting of hydrogen, nitrogen, hydrogen sulfide, ammonia, methane, ethane, ethylene, propane, propylene, butanes, and butylenes, and combinations thereof.

12. The process of claim 1 wherein substantially all of said feed is apportioned between the lowest injection position and a second, higher injection position.

13. The process of claim 1 wherein the temperature of the riser reactor outlet is maintained between 900° F. to 1100° F.

14. The process of claim 1 wherein one of the upper injection points is located in the reactor or stripper vessel.

* * * * *